US006222794B1

(12) United States Patent
Woodall et al.

(10) Patent No.: US 6,222,794 B1
(45) Date of Patent: Apr. 24, 2001

(54) UNDERWATER NOISE GENERATOR ACTUATED BY MAGNETO-INDUCTIVE/ ACOUSTIC SIGNALS

(75) Inventors: Robert Woodall, Lynn Haven; Felipe Garcia, Panama City, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/397,841

(22) Filed: Sep. 17, 1999

(51) Int. Cl.[7] ..... H04K 3/00
(52) U.S. Cl. ..... 367/1
(58) Field of Search ..... 367/1, 140; 181/113; 116/27

(56) References Cited

U.S. PATENT DOCUMENTS 3,841,219 * 10/1974 Schillreff ..... 367/1
4,183,008 * 1/1980 Crist ..... 367/1
4,189,026 * 2/1980 Elliot et al. ..... 181/118
4,207,626 * 6/1980 Wedding et al. ..... 367/173
4,307,665 * 12/1981 Block et al. ..... 102/505
5,721,711 * 2/1998 Fine et al. ..... 367/1

* cited by examiner

*Primary Examiner*—Ian J. Lobo
(74) *Attorney, Agent, or Firm*—Harvey A. Gilbert; Donald G. Peck

(57) ABSTRACT

An underwater noise generator has a submerged housing containing a receiver section responsive to remotely originating acoustic signals or magneto-inductive signals in the ELF to VLF range. The submerged housing contains a composition that reacts with water to produce gas. The signals initiate an explosive squib that blows a lid off the housing and penetrates a wall that covers the composition. Water floods into the housing and onto the composition which produces gas that creates bubbles. The bubbles are buoyed from the noise generator to the surface and, in so doing, they produce noise. Underwater noise generators can be used singularly, in multiples, or in various patterns as needed to conceal activities or otherwise deceive remote listeners. Appropriately coded magneto-inductive control signals in the ELF to VLF range are transmitted from a variety of remote sources through the sea, air, vegetation, and sediment or any combination of these conditions to activate the underwater noise generators.

20 Claims, 1 Drawing Sheet

UNDERWATER NOISE GENERATOR ACTUATED BY MAGNETO-INDUCTIVE/ ACOUSTIC SIGNALS

CROSS REFERENCE TO RELATED APPLICATIONS

This is a continuation-in-part of U.S. patent applications entitled "Magneto-Inductively Controlled Limpet" by John Sojehei et al., U.S. Patent and Trademark Office Ser. No. 09/135,316 (NC 78,836), filed Aug. 10, 1998, now U.S. Pat. No. 6,112,668, "Magneto-Inductive Seismic Fence" by Robert Woodall et al., U.S. Patent and Trademark Office Ser. No. 09/030517 (NC 78,866), filed Feb. 23, 1998, now U.S. Pat. No. 5,696,608, "Magneto Inductive On-Command Fuze" by Felipe Garcia et al., U.S. Patent and Trademark Office Ser. No. 09/228074 (NC 78,802), filed Jan. 5, 1999, and "Magneto-Inductive Submarine Communications System and Buoy" by Robert Woodall et al., U.S. Patent and Trademark Office Serial No. 09/135316 (NC 78,948), filed Aug. 10, 1998, U.S. Pat. No. 6,058,071, and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to noise generators. In particular, this invention relates to underwater noise generators actuated from a remote location by acoustic signals or magneto-inductive signals propagated at extremely low to very low frequencies to produce bubbles that create acoustic noise that may conceal movements or deceive listeners.

Currently, electromechanical pingers, sacrificial vehicles, and remotely controlled vehicles are used to create noise in a given area. Some systems use explosive charges to create underwater acoustic noise. These devices for producing noise, however, are difficult to inconspicuously emplace at one time and reliably actuate later by remote means when the tactical situation is more favorable.

Previously, acoustic command signals have been used to control a variety of instrumentation and ordnance packages. However, acoustic command signals have limited applications since sound cannot effectively be communicated through the air to receivers in the water. In addition, reliable communication with acoustic devices is affected by sediment, microorganisms, algae, changes in salinity, thermoclines, and multi paths in the water. Acoustic devices may also be unreliable at detecting acoustic command signals in the water in the presence of ambient noise that may come from ships, mammals, munitions, landing craft, sonar, and crashing surf. Acoustic devices are known to be incapable of reliable performance in the littoral regions associated with amphibious assault, particularly in the surf zone and noisy harbors.

A further limitation in the use of acoustic signals is that they are undesirable from a stealth perspective. If an acoustically responsive package is emplaced and an attempt is made to communicate with it using sonar from a friendly submarine, for example, the submarine's position may be given away and triangulated upon by others using passive acoustic detection in the area.

Thus, in accordance with this inventive concept, a need has been recognized in the state of the art for an underwater noise generator creating noise from bubbles in response to remotely originating acoustic or magneto-inductive signals.

SUMMARY OF THE INVENTION

The invention is directed to providing an underwater noise generator having a chamber containing a composition to react with water to produce gas. A lid closes the chamber, and a receiver section in the chamber is connected to an explosive squib. The receiver section is responsive to signals from a remote source to detonate the squib and blow the lid away. This allows water to flood the chamber and onto the composition to produce the gas and make bubbles that create noise.

An object of the invention is to provide an underwater sound generator using a composition to produce bubbles when it reacts with seawater to create noise.

Another object of the invention is to provide an underwater sound generator responsive to actuation by remotely originating command signals.

Another object of the invention is to provide a noise source pre-emplaced for later actuation by remote signals.

Another object of the invention is to provide underwater noise generators actuated singularly, in multiples, in various patterns, or all at once as tactics warrant.

Another object is to provide an underwater noise generator using inexpensive calcium carbonate instead of more complicated, less reliable electromechanical systems.

An object of the invention is to provide an underwater noise source reliably activated by magneto—inductive signals.

Another object of the invention is to provide a noise source actuated by acoustic signals or magneto-inductive signals in the ELF to VLF range from remote locations.

These and other objects of the invention will become more readily apparent from the ensuing specification when taken in conjunction with the appended claims.

DESCRIPTION OF THE PREFERRED EMBODIMENT

Figure 1:
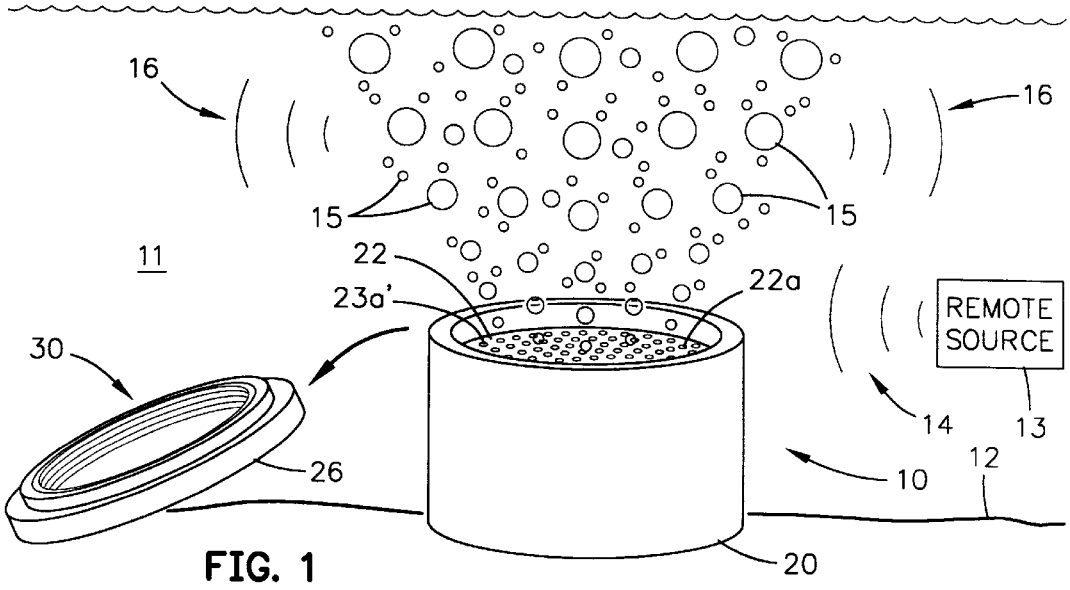
FIG. 1 isometrically depicts the invention flooded with seawater and producing noise generated by bubbles in response to command signals from a remote source.

Referring to FIG. 1 of the drawings, underwater noise generator 10 is schematically depicted after it has been deployed to rest on bottom 12 of a body of water 11 that may be either fresh or saltwater. Remote source 13 transmits command signals 14 to activate it. Consequently, underwater noise generator 10 generates gas bubbles 15 that are released and rise as they are buoyed upward through water 11 to create noise 16 that radiates omnidirictionally away from generator 10.

Noise generator 10 is actuated by remotely transmitted signals 14, e. g., acoustic signals or magneto-inductive signals in the extremely low frequency (ELF) to very low frequency (VLF)range, (1–4000 Hertz). Acoustic signals may be suitable for some applications, but magneto-inductive signals are preferred for reliability in high noise backgrounds, such as those encountered during most combat or assault operations. Signals in ELF/VLF range also safely and reliably activate noise generator 10 through the sea, air, marine plant life, and sediment, or combinations of these conditions.

Magneto-inductive transmission with magneto-inductive signals relies on the use of the quasi-static AC magnetic field generated by a transmitting antenna operated with very low radiation impedance. The transmitting antenna at remote source 13 is either air-cored or may employ steel or ferrite for field enhancement. The receiver antenna at noise generator 10 may have a similar construction as the antenna at remote source 13.

Figure 2:
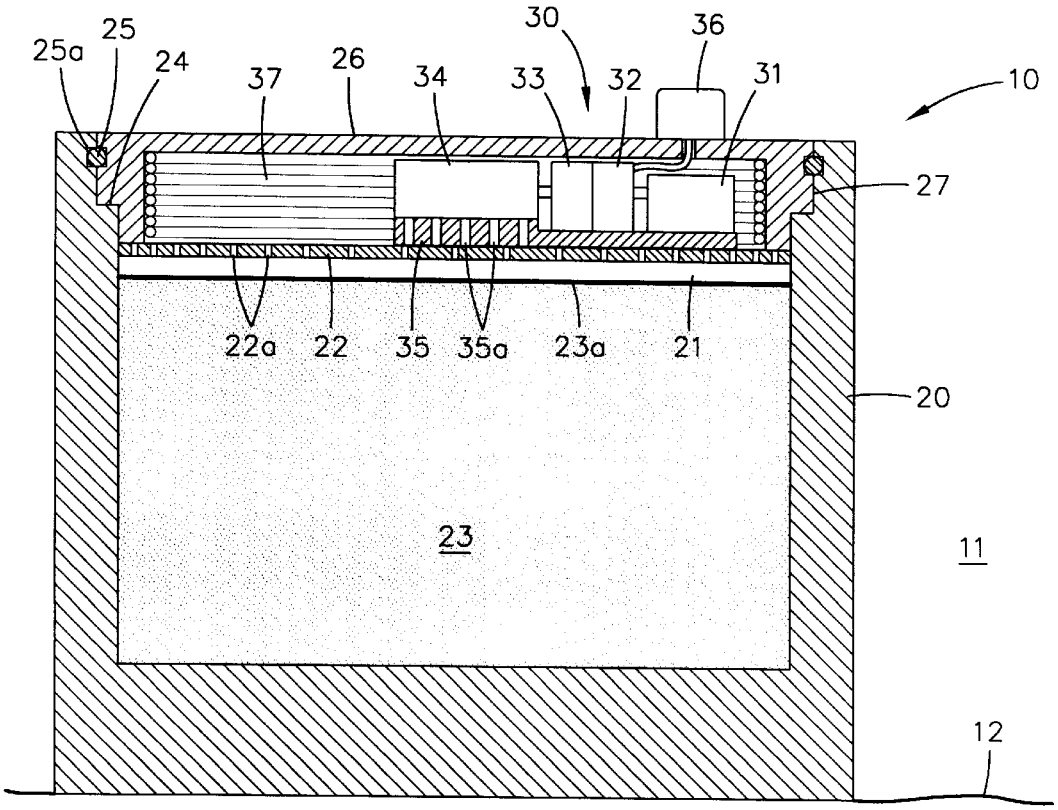
FIG. 2 is a cross-sectional view of the invention prior to initiation of its explosive squib by command signals.

Referring also to FIG. 2, noise generator 10 has housing 20 fabricated from relatively heavy or non-buoyant materials that provide sufficiently rugged structures and assure that noise generator 10 sinks to bottom 12. Housing 20 has chamber 21 having an open end that has rigid wall 22 that is fitted to extend across it. Wall is provided with a number of holes 22*a* and covers composition 23. Composition 23 has foil seal 23*a* across its top to cover and seal moisture from it. Composition 23 is contained and pressed-in chamber 21 and has chemical properties to produce gas when it comes in contact with and reacts with water 11. One such composition 23 is calcium carbonate. Other compositions or substances could be used to produce the same or other gasses when they react with water 11.

Housing 20 is provided with annular recess 24 having O-ring 25 in annular groove 25*a*. A non-metalic lid 26 snugly fits into recess 24, and 0-ring 25 engages rim 27 of lid 26. Rim 27 may or may not have an annular groove in it that corresponds with annular groove 25*a* to help retain O-ring 25. In either case, this fitting, or engagement seals moisture out of chamber 21 and from composition 23 and secures lid 26 and housing 20 together to close an open end of chamber 21. Lid 26 also may be used to support or mount receiver section 30 inside chamber 21 of housing 20.

Receiver section 30 includes interconnected integrated battery 31, receiver/logic board 32, capacitor-discharge firing circuit 33, and explosive squib 34. Detonation of squib 34 is thereby assured when appropriate command signals 14 are sent from remote source 13.

Receiver section 30 may be connected to hydrophone 36 mounted on the outside of lid 26 to receive the remotely originating acoustic command signals 14. Optionally, when remote source 13 transmits magneto-inductive command signals 14 in the ELF to VLF range, antenna 37 may be mounted inside of lid 26 or wrapped around the inside of housing 20 to receive them. Either way, the received signals are fed to receiver section 30 inside housing 20.

Squib 34 is mounted on squib holder plate 35 that is screwed into or otherwise secured to lid 26. Plate 35 is interposed between squib 34 and wall 22 and is provided with a number of vent holes 35*a* between squib 34 and wall 22. When squib 34 is detonated, it generates an explosive pressure wave that is forcefully directed between holder plate 35 and lid 26. Lid 26 is blown off by this explosive pressure wave. The explosive pressure wave also ruptures holes 23*a*' in foil seal 23*a*. Holes 23*a*' are aligned with holes 22*a* in plate 22 to expose calcium carbonate composition 23 to water 11 and cause a chemical reaction. Bubbles 15 produced by this reaction are freely vented back through holes 23*a*' and aligned holes 22*a*. The vented gas bubbles 15 rise from noise generator 10 to the surface of water 11. During generation and buoying of bubbles 15, noise 16 is created that lasts until composition 23 is depleted.

Remote source 13 usually is located a distance that may reach several kilometers away from noise generator 10. Source 13 may be a land-based command station, surface craft, or submarine that transmits the appropriately coded or encrypted acoustic and/or magneto-inductive signals 14.

Typically, remote source 13 could be a magneto-inductive signal transmitter that transmits command signals 14 in the ELF to VLF range to activate underwater noise generator 10. Source 13 may include interface and control logic, power supply, power output stage, and magneto-inductive transmitter antenna. The firing command is sent to the interface and control logic unit. This unit may encode the command to a series of tones and may modulate these tones by using the audio frequency shift keying (AFSK) modulation technique at a carrier frequency between 1 and 4000 Hz. The AFSK technique allows generation of command signals 14 that may be encrypted and unique. The power supply drives power output stage consisting of power MOSFET drivers which drive the antenna to transmit command signals 14. Because the frequencies of command signals 14 are in the ELF to VLF range, they propagate readily through water 11, surrounding biota, sediments, and seabed to actuate underwater noise generator 10.

Acoustic versions of remote source 13 and noise generator 10 operate at frequencies common to the sonar industry. When remote source 13 is a sonar transmitter, then effective propagation of sonar command signals 14 would be limited to noise generators 10 located in water 11. This is because sonar command signals 14 are not likely to reach noise generators 10 buried in the ocean bottom or located where there is masking by large amounts of biota, sediment, or thermoclines that would distort the sonar signals. Consequently, sonar command signals 14 are less apt to be used to attempt to actuate these noise generators.

In operation, noise generator 10 is carried by swimmers or submersibles, dropped from aircraft or surface craft, or otherwise deployed in water 11. After it comes to rest on bottom 12, it could remain there for a considerable period of time that might be limited by the life of batteries 31.

When the right tactical opportunity develops, signal 14 is generated at remote source 13 and transmitted. Signal 14 is received by either hydrophone 36 or ELF/VLF antenna 37 and is fed to receiver/logic board 32 of receiver section 30. In receiver/logic board 32 received signal 14 is detected, amplified, compared to a stored signal, and evaluated by a logic circuit in logic board 32. If the comparison and evaluation determine that the signal is valid, then the logic circuit initiates charging of a capacitor of capacitor-discharge firing circuit 33 via battery 31. When a predetermined charge is accumulated, the current is dumped to interconnected explosive squib 34. This detonates squib 34, and a forceful pressure wave is produced inside of housing 20.

The forceful pressure wave accomplishes two things: 1.) it separates, or blows lid 26 from housing 20, and 2.) it ruptures, or blows holes 23*a*' in foil seal 23*a*. Holes 22*a* in wall 22 assure that only aligned holes 23*a*' are made in foil seal 23*a*, and calcium carbonate composition 23 is not exposed, or subjected-to the full impact of the explosive pressure wave from squib 34. Otherwise, the unrestricted pressure wave might blow-apart or crater composition 23, or otherwise impair its effectiveness to produce bubbles 15.

Holes 23*a*' in foil seal 23*a* allow water 11 to pour, or flood into chamber 21 and come in contact with composition 23 of calcium carbonate. The chemical reaction between calcium carbonate composition 23 and water 11 produces carbon dioxide gas which forms bubbles 15 in water 11. As bubbles 15 travel to the surface, acoustic noise 16 is produced that continues for several minutes until all the calcium carbonate is consumed.

Underwater noise generator 10 may be used to create acoustic noise along a defended coastline to conceal the activities of friendly forces. Underwater noise generators 10 can be pre-emplaced in quantity or singularly, as tactics dictate, along a defended friendly or foreign shore. Later, noise generators 10 can be activated singularly, in multiples, or in various patterns as desired. This is because each noise generator 10 has receiver section 30 that actuates squib 34 upon receipt of remotely originating acoustic or magneto-inductive firing command signals 14. Actuation of noise generators 10 reliably produces bubbles that create acoustic noise 15 in water 11 that is detected by foreign sensors. Inexpensive calcium carbonate may be used instead of more complicated, less reliable electromechanical systems or unstable chemicals, such as sodium, to produce bubble noise. The noise produced by one or more noise generators 10 in water 11 will mask the ability of foreign sensors to detect real activities and targets, and also may be used to deceive foreign listeners into believing that targets which are actual threats are in the area.

The invention herein has been described using an exemplary arrangement of components to remotely activate underwater noise generators 10. Having this disclosure in mind, one skilled in the art to which this invention pertains will select and assemble suitable components from among a wide variety available in the art and appropriately interconnect them. This example, therefore, is not to be construed as limiting, but rather is intended to demonstrate this inventive concept.

The disclosed components as disclosed herein all contribute to the novel features of this invention. These novel features assure more reliable and effective use of underwater noise generators 10 to successfully perform a wide variety of tasks. The configuration and capabilities of underwater noise generator 10 could be modified to accommodate different requirements and still be within the scope of this inventive concept. For example, noise generator 10 could be adapted to release oxygen and used by the marine fisheries industry to introduce oxygen into an area having low oxygen levels to improve the survivability of fish. When the oxygen releasing chemicals of composition 23 are activated, life-saving oxygen is available for the fish, and a lower power squib 34 might be used to prevent concussions that might injure the fish. Such changes do not depart from the scope of this invention.

Many modifications and variations of the present invention are possible within the purview of the claimed invention. It is to be understood that within the scope of the appended claims the invention may be practiced otherwise than as specifically described.

We claim:

1. An underwater noise generator comprising:

a housing having a chamber with an open end;

a composition in said chamber to react with water to produce gas;

a lid fit in said open end to close said chamber; and a receiver section in said chamber connected to an explosive squib, said receiver section being responsive to signals from a remote source to detonate said squib and blow said lid from said housing.

2. An underwater noise generator according to claim 1 further comprising:

a foil seal covering said composition, said detonation of said squib rupturing said foil seal.

3. An underwater noise generator according to claim 2 further comprising:

a wall covering said composition, said wall having holes therein.

4. An underwater noise generator according to claim 3 in which said detonation allows water to flood into said chamber and onto said composition to produce said gas and make bubbles that create noise.

5. An underwater noise generator according to claim 4 in which said receiver section is mounted on said lid and includes interconnected battery, receiver/logic board, and capacitor-discharge firing circuit connected to said squib.

6. An underwater noise generator according to claim 5 further comprising:

holder plate adjacent said squib and mounted on said lid, said holder plate having holes adjacent said wall.

7. An underwater noise generator according to claim 6 in which said holes of said wall and said holder plate are disposed to allow a pressure wave caused by said detonation to rupture said foil seal.

8. An underwater noise generator according to claim 7 further comprising:

an annular recess in said housing having an annular groove containing an O-ring, said lid being sized to fit in said annular recess and said O-ring engaging said lid to seal moisture out of said chamber and said composition and to secure said lid and said housing together.

9. An underwater noise generator according to claim 8 further comprising:

an antenna inside said housing being coupled to said receiver section and being responsive to said remote signals, said remote signals being magneto-inductive signals in the ELF to VLF range.

10. An underwater noise generator according to claim 8 further comprising:

a hydrophone mounted on said lid being coupled to said receiver section and being responsive to said remote signals, said remote signals being acoustic signals.

11. A method of generating noise underwater comprising the steps of:

providing a housing having a chamber with an open end;

placing a composition in said chamber to react with water to produce gas;

fitting a lid in said open end to close said chamber;

connecting an explosive squib in a receiver section in said chamber;

receiving command signals from a remote source in said receiver section; and detonating said squib in said chamber in response to said command signals.

12. A method according to claim 11 further including the steps of:

blowing said lid from said chamber; and flooding water into said chamber and onto said composition.

13. A method according to claim 12 further comprising the steps of:

producing gas and bubbles from reaction between said water and said composition; and creating noise from said bubbles as they rise to the surface of said water.

14. A method according to claim 13 further comprising the step of:

transmitting acoustic command signals from said remote source to said receiver section.

15. A method according to claim 13 further comprising the step of:

transmitting magneto-inductive command signal from said remote source to said receiver section.

16. An underwater noise source comprising:

means for defining a chamber;

means for providing composition in said chamber defining means to react with water to produce gas;

means for closing said chamber defining means;

means in said chamber defining means for producing an explosion; and means in said chamber defining means for receiving signals to detonate said explosion producing means and blow said closing means from said chamber defining means.

17. A noise source according to claim 16 further comprising:

means extending across said chamber defining means above said composition providing means for providing a wall having holes therein; and means for covering said composition providing means, said detonation of said explosion producing means rupturing said covering means.

18. A noise source according to claim 17 in which said detonation allows water to flood into said chamber defining means and onto said composition providing means to produce said gas and make bubbles that create noise.

19. A noise source according to claim 18 in which said receiving means is mounted on said closing means and includes interconnected battery, receiver/logic board, and capacitor-discharge firing circuit connected to said explosion producing means.

20. A noise source according to claim 19 further comprising:

means for holding said explosion producing means on said closing means.

* * * * *